US008898862B1

(12) United States Patent
McGrath

(10) Patent No.: US 8,898,862 B1
(45) Date of Patent: Dec. 2, 2014

(54) PUSH-BUTTON, LOCKING HINGE ASSEMBLY

(71) Applicant: Andrew H. McGrath, Concord, CA (US)

(72) Inventor: Andrew H. McGrath, Concord, CA (US)

( * ) Notice: Subject to any disclaimer, the term of this patent is extended or adjusted under 35 U.S.C. 154(b) by 0 days.

(21) Appl. No.: 14/264,722

(22) Filed: Apr. 29, 2014

(51) Int. Cl.
*E05D 11/10* (2006.01)
*E05D 7/00* (2006.01)

(52) U.S. Cl.
CPC ..... *E05D 7/00* (2013.01)
USPC ..... 16/326; 16/334

(58) Field of Classification Search
USPC ..... 16/324, 326–328, 352, 353, 320, 321, 16/331, 335, 349, 371; 403/93, 94, 96, 97, 403/103, 104
See application file for complete search history.

(56) References Cited

U.S. PATENT DOCUMENTS

| | | | | |
|---|---|---|---|---|
| 5,039,118 | A * | 8/1991 | Huang | 280/47.371 |
| 5,123,768 | A * | 6/1992 | Franklin | 403/96 |
| 5,168,601 | A * | 12/1992 | Liu | 16/445 |
| 5,765,958 | A * | 6/1998 | Lan | 403/97 |
| 6,629,801 | B2 * | 10/2003 | Cheng | 403/101 |
| 7,617,569 | B2 * | 11/2009 | Liao | 16/334 |
| 7,631,575 | B2 * | 12/2009 | Gard et al. | 74/530 |
| 2002/0131814 | A1 * | 9/2002 | Hou et al. | 403/97 |
| 2004/0179891 | A1 * | 9/2004 | Watkins et al. | 403/96 |

* cited by examiner

*Primary Examiner* — Chuck Mah
(74) *Attorney, Agent, or Firm* — Charles L. Thoeming

(57) ABSTRACT

A push-button, locking hinge assembly includes a base element, a push-button element, a cap element, an assembly to lock these three elements about a central axis, and a release assembly allowing the cap element to pivot 360 degrees transversely to the central axis and in relation to the base element. Geometric ends of the hinge assembly allow insertion into any two components to be so releasably pivoted and repositioned, and then locked into a desired position relative one to the other.

14 Claims, 3 Drawing Sheets

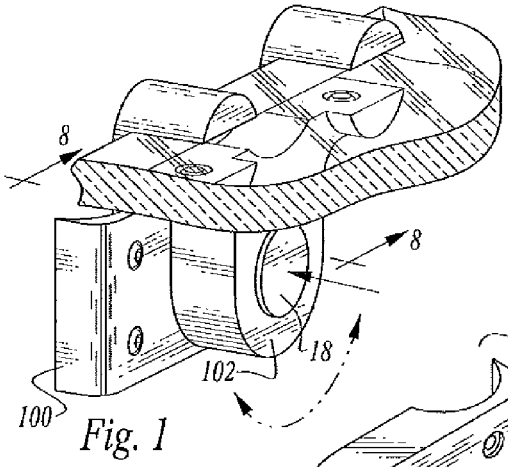
Fig. 1
Fig. 2
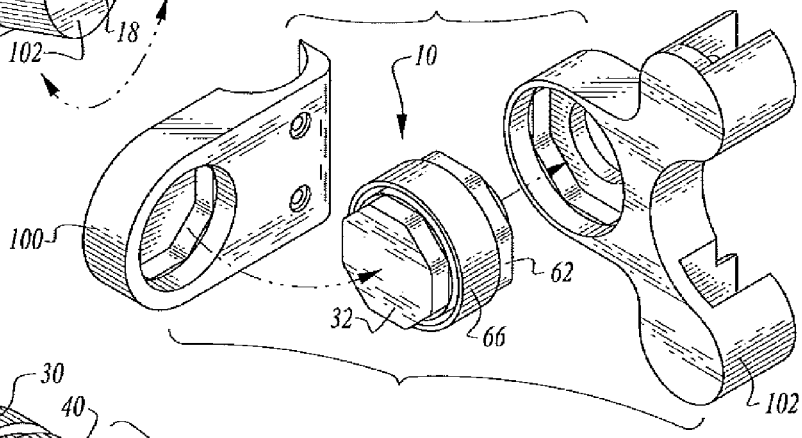
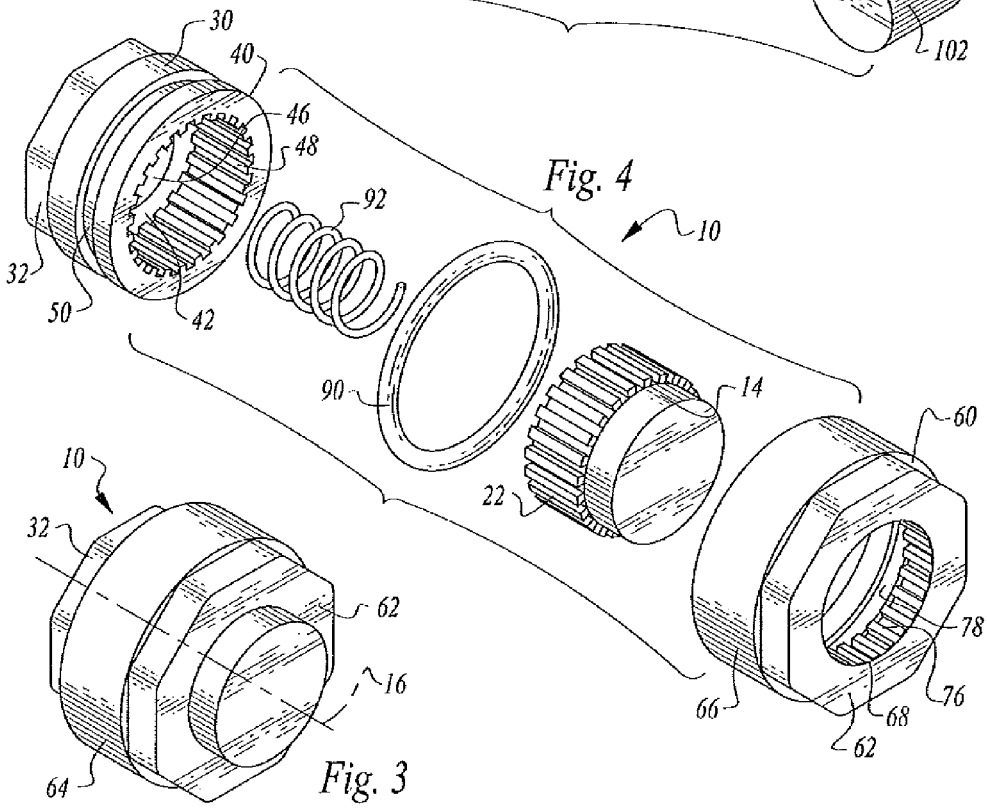
Fig. 4
Fig. 3

PUSH-BUTTON, LOCKING HINGE ASSEMBLY

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates to a push-button, locking hinge assembly that, for instance, is adaptable to ready-to-assemble components used in adjustable bracket assemblies for adapting to and connecting one or more substantially external support member(s) defined by the particular utility of the overall assembly to at least one fixed support structure, and for providing a locking hinge assembly to positionally adjust and secure a planar member 360 degrees about a central hinge axis orthogonally disposed to the support structure.

BACKGROUND OF THE INVENTION

Adjustable and lockable hinge assemblies for bracketing are well known in the art and typically comprise a limited degree of range of motion aligned with a central hinge axis, as exemplified by door hinge assemblies.

Designing and assembling these hinge elements is ordinarily complicated since dimensions, load factors, code requirements, and aesthetics converge to present brackets which are labor and component intensive. Often bracketing assemblies will have many component parts and require several tools for assembly. Moreover, with current technology, bracket assembly require broader ranges of hinge adaptability than what is provided in the art, and even when a custom design is presented, the bracket assembly is time consuming.

Various types of adjustable and lockable hinge assemblies are used for securing bracketing components or bracketing assemblies integrally or to other external structures, and/or immobilizing and/or adjusting one component with respect to another component about a common axis. Many ready to assemble bracket assemblies utilize location dependent uprights or support members that multiply the effort needed to design and assemble adjustable and lockable hinge assemblies and that intensify the complexity of the process.

Presently most adjustable and lockable hinge assemblies for bracketing are installed by the seller because of the complexity of assembling. Thus, many bracketing assemblies are handled fully or most fully assembled which presents bulky cargo that takes up considerable amount of space and is difficult to transport.

Additionally, when one part of a piece of an adjustable and lockable hinge assembly is damaged, often the entire product must be returned instead of the damaged part. For example, when an adjustable and lockable hinge element for an upright or support bracketing assembly fails or is defective, often the entire bracketing assembly must be replaced.

Finally, the adjustable and lockable hinge assembly needs to be supported by adequate and aesthetically pleasing attachment components for securing one or more of the hinge assemblies to one or more bracket assemblies or fixed support structures.

DISCLOSURE OF INVENTION

The present invention relates to adjustable and lockable hinge assemblies that can be employed readily over a wide array of bracketing applications to securely connect a variety of longitudinally oriented support members to at least one fixed support structure, while still satisfying the complement of requirements presented by dimensions, load factors, codes, and design preferences. Furthermore, the adjustable and lockable hinge assemblies disclosed and claimed herein are fashioned in such a manner as to maximize the utility of the embodiments of hinge assemblies over a broad range of applications, while minimizing the labor, parts and tools required for implementation. Since the adjustable and lockable hinge assemblies are is characterized by their universality and relative simplicity and ease of installation, they serve to fulfill both original and retrofit adjustable and lockable hinge requirements for bracketing applications. The adjustability feature of the adjustable and lockable means that less "design customizing" is required for a given installation, thus leading to demonstrable cost savings.

For example, without limitation, an embodiment of the adjustable and lockable hinge assembly is adaptable to bracket assemblies for mounting, positioning and securing longitudinally disposed bracket panel members to at least one fixed support structure, and allowing for 360 degree positional adjustment of the longitudinally disposed bracket panel members along the adjustable and lockable hinge central axis.

The adjustable and lockable hinge assembly provides a push-button, locking hinge assembly that includes a base element, a push-button element, a cap element, an assembly to lock these three elements about a central axis, and a release assembly allowing the cap element to pivot 360 degrees transversely to the central axis and in relation to the base element. Geometric ends of the hinge assembly allow insertion into any two components to be so releasably pivoted and reposition, and then locked into a desired position relative one to the other.

BRIEF DESCRIPTION OF DRAWINGS

Further features and advantages will become apparent from the following detailed description made with reference to the accompanying drawings, wherein:

FIG. 1 is a perspective view of an embodiment of a push-button, locking hinge assembly 10 that is adapted to a bracket support 100 and an adjustable bracket 102 allowing the adjustable bracket 102 to pivot 360 degrees transversely to the central axis and in relation to the bracket support 100 when pressure is applied to the actuating end 18.

FIG. 2 is an exploded perspective view of the embodiment of a push-button, locking hinge assembly 10 of FIG. 1, depicting an octagonal base end 32 being adaptively received and secured by an octagonal opening in the bracket support 100, and an octagonal cap end 62 being adaptively received and secured by an octagonal opening in the adjustable bracket 102.

FIG. 3 is a perspective view of the embodiment of the push-button, locking hinge assembly 10 of FIGS. 1 and 2.

FIG. 4 is an exploded perspective view of the embodiment the of push-button, locking hinge assembly 10 of FIG. 3.

MODES FOR CARRYING OUT THE INVENTION

Figure 5:
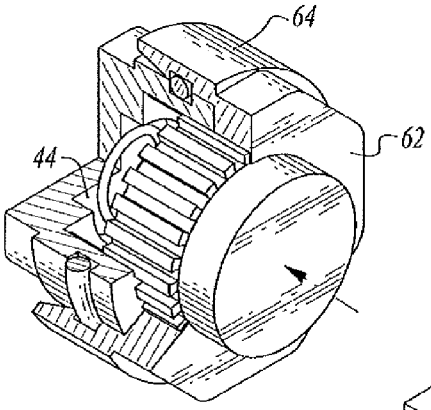
FIG. 5 is a partial cut-away perspective view of the embodiment of the push-button, locking hinge assembly 10 of FIG. 3, depicting the pressure applied to the actuating end 18.
Figure 7:
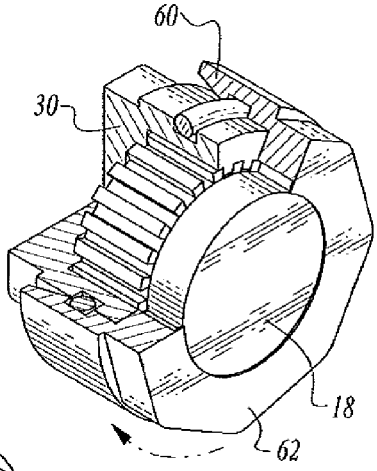
FIG. 7 is a partial cut-away perspective view of the embodiment of the push-button, locking hinge assembly 10 of FIG. 6, depicting the cap 60 pivoting 360 degrees transversely to and about the push-button, locking hinge central axis 16.
Figure 6:
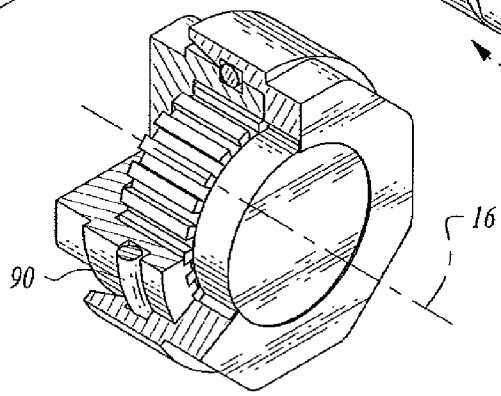
FIG. 6 is a partial cut-away perspective view of the embodiment of the push-button, locking hinge assembly 10 of FIG. 5, depicting movement of the push-button element towards the base element 30 wherein the push-button cogs 22 are disengaged from the cap cogs 76.
Figure 8:
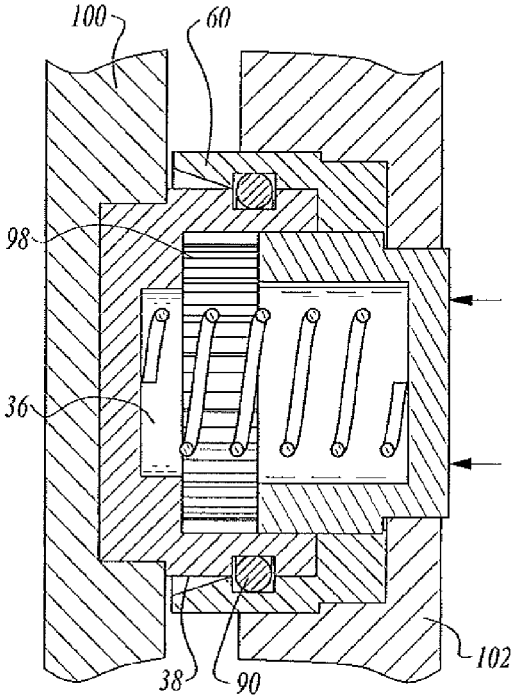
FIG. 8 is a cross-sectional view of FIG. 1 taken at "8-8" and depicting the embodiment of a push-button, locking hinge assembly 10 that is adapted to a bracket support 100 and an adjustable bracket 102 allowing the adjustable bracket 102 to pivot 360 degrees transversely to the central axis and in relation to the bracket support 100 when pressure is applied to the actuating end 18.
Figure 9:
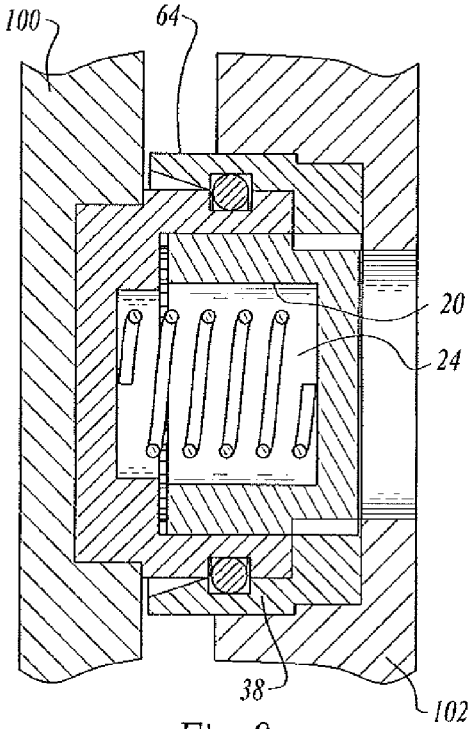
FIG. 9 is a cross-sectional view of FIG. 1 taken at "8-8" and depicting movement of the embodiment of the push-button element towards the base element 30 wherein the push-button cogs 22 are disengaged from the cap cogs 76.

This detailed description merely describes exemplary embodiments and is not intended to limit the scope of the claims in any way. Indeed, the invention as claimed is broader than and unlimited by the exemplary embodiments, and the terms used in the claims have their full ordinary meaning. For example, while the specific embodiments described herein relate to various assemblies using the push-button, locking hinge assembly for securing bracketing components or bracketing assemblies integrally or to other external structures, and/or immobilizing and/or adjusting one component with respect to another component about a common axis, the exemplary features and embodiments of the present application may additionally or alternatively be applied to other types of locking hinge arrangements, including, for example, various types of portable screens, panel bracketing, extending ladders, extending support hinges, folding hinges, rotisserie assemblies, frame hinges, hinges that permanently attach, releasably attach, and/or remain detached from a bracketing assembly, or other assembly providing one or more paired components to be rotated and secured, one relative to the other, and other types of uses, for example, with other portable items, such as, without limitation, sneeze guard assemblies, screens, tables, beds, panel stands, lecterns, carrying racks, storage racks, furniture, grills, tools, and electronic devices.

Referring now to FIG. 1-11, a push-button, locking hinge assemblies are illustrated and designated by reference numerals 10 and 12.

An embodiment of a push-button, locking hinge assembly 10 includes a base element 30 having a solid cast geometric end 32 and a central longitudinal axis central longitudinal axis 16, FIGS. 4-9. A base element 30 solid cast geometric end 32 internal recess 36 is sized to receive a resilient spring 92. A base element 30 cylindrical length 38 has an external side 40 and an internal side 42, with a cylindrical recess 44 defined by the cylindrical length 38 internal sides 42, and an open end 46. A plurality of uniform cogs 48 are evenly spaced along the base element 30 cylindrical length 38 internal side 42 from the open end 46 so that each cog 48 length is disposed equidistant from and parallel to the central longitudinal axis 16.

The base element 30 cog 48 is sized to fit and receive the push-button element 14 cogs 22 along the base element 30 cylindrical length 38 internal side 42 from the open end 46 FIGS. 4, 5-9.

An annular groove 50 around the base element 30 cylindrical length defines a plane transverse to the central longitudinal axis 16, and the annular groove 50 is sized to receive and hold an O-ring 90, FIGS. 4, 5-9. Embodiments of the push-button, locking hinge assembly 10 or 12 includes use of an O-ring lubricant, such as DuPont® Krytox®, or Dow Corning® III O-Ring Valve Silicone Lubricant, or similar products to maintain the ease of motion for the pivot of the cap element 60 around the base element 30 along O-ring 90 within annular grooves, 78 and 50, respectively.

Figure 10:
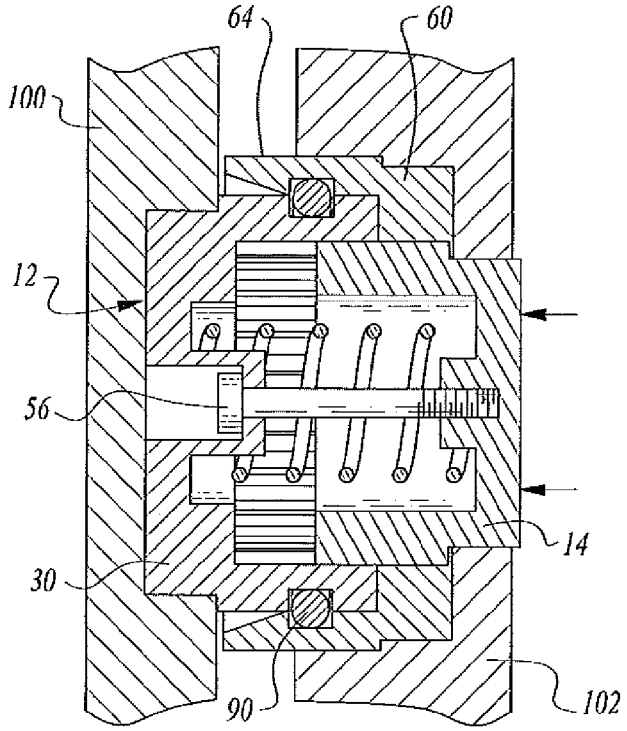
FIG. 10 is a cross-sectional view of an embodiment of a push-button, locking hinge assembly 12 corresponding to FIG. 8, but that includes a fastener 56 further securing the base 30 to the push-button 14, and pressure applied to the push-button 14 actuating end 18.
Figure 11:
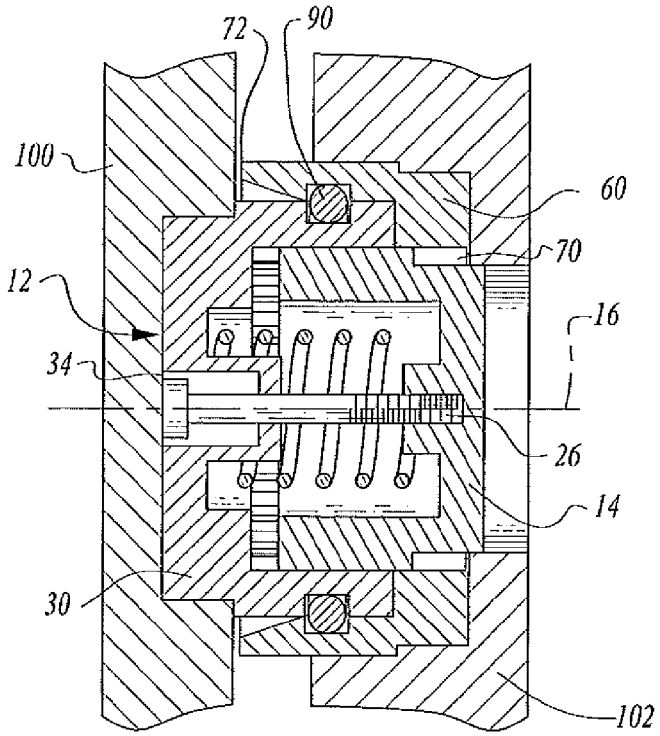
FIG. 11 is a cross-sectional view of an embodiment of a push-button, locking hinge assembly 12 corresponding to FIG. 9, but that includes a fastener 56 further securing the base 30 to the push-button 14, and the cap 14 and corresponding adjustable bracket 102 can be rotated 360 degrees about the pivot point O-ring 90 transversely to and about the push-button, locking hinge central axis 16.

An embodiment of a push-button, locking hinge assembly 12, FIGS. 10-11, further provides an aperture 34 centered on the base element 30 solid cast geometric end 32, a threaded opening 26 on the push-button element 14 actuating end 18 internal surface, and a threaded fastener 56 sized to correspond to the threaded opening 26 and join the base element 30 to the push-button element 14 by insertion of the threaded fastener 56 into the push-button, locking hinge assembly 12 assembly through the aperture 34 and extending along the central longitudinal axis 16 within the resilient spring 92. Adjustment of the length of threaded fastener 56 received by the push-button element 14 actuating end 18 internal surface by axial rotation of the threaded fastener 56 causes the push-button element 14 actuating end 18 either to protrude from the surface 102 of a component receiving each cap element 60 solid cast geometric end or be flush with the component surface 102, FIGS. 1-3, 10-11.

An embodiment of a push-button, locking hinge assembly 10 further includes a push-button element 14 including a cylindrical body having external and internal sides and a central longitudinal axis 16, FIGS. 4-9. The push-button element 14 provides an actuating end 18 including a solid circular external surface and an internal recess 24. The push-button element 14 further provides an open cylindrical end with a cylindrical recess 20 defined by the cylindrical body internal sides. A plurality of push-button element 14 cogs 22 are evenly spaced along the push-button element 14 cylindrical body external side so that each cog 22 length is disposed equidistant from and parallel to the push-button element 14 cylindrical body central longitudinal axis 16. The push-button element 14 internal recess 24 is sized to receive a resilient spring member 92.

An embodiment of a push-button, locking hinge assembly 10 further includes a cap element 60 having a solid cast geometric end 62 and a central longitudinal axis 16, FIGS. 4-9. The cap element 60 provides an opening centered on the solid cast geometric end 62, the opening sized to receive the push-button element 14 provides an actuating end 18. The cap element 60 includes a cylindrical length 64 comprising an external side 66 and an internal side 68, and a cylindrical recess 70 defined by the cylindrical length 64 internal sides 68. A cap element 60 open end 72 is sized to receive and hold the base element 30 open end 46. A plurality of cap element 60 uniform cogs 76 are evenly spaced along the cap element 60 cylindrical length 64 internal side 68, so that each cog 76 length is disposed equidistant from and parallel to the cap element 60 cylindrical length 64 central longitudinal axis 16. An annular groove 78 around the cap element 60 cylindrical length 64 internal side 68 defines a plane transverse to the cap element 60 central longitudinal axis 16, and is sized to receive and hold the O-ring 90 received within the annular groove 50 around the base element 30 cylindrical length 38 external side 40.

An embodiment of the push-button, locking hinge assembly 10 provides a locking feature when the push-button element 14 actuating end 18 is in a disengaged, neutral position and the push-button element 14 cogs 22 simultaneously engage the base element 30 cogs 48 and the cap element 60 cogs 76 preventing any pivot about the central longitudinal axis 16.

An embodiment of the push-button, locking hinge assembly 10 provides a 360 degree pivot feature between the cap element 60 and the base element 30, the pivot action being transverse to and about the central longitudinal axis 16 with the cap element 60 and the base element 30 pivoting around each other along the O-ring 90, when the push-button element 14 actuating end 18 is depressed inward disengaging the push-button element 14 cogs 22 from the cap element 60 cogs 76 and unlocking the push-button, locking hinge assembly 10, FIGS. 1, 5-9. Once the push-button element 14 actuating end 18 returns to a neutral position by the action of the undepressed resilient spring 92 when the pressure is withdrawn from the push-button element 14 actuating end 18, the push-button element 14 cogs 22 re-engage the cap element 60 cogs 76 and lock the push-button, locking hinge assembly 10 into the adjusted pivoted position between the base element 30 and the cap element 60 about the central longitudinal axis 16.

Embodiments of the push-button, locking hinge assembly 10 or 12 include use of an O-ring lubricant, such as DuPont® Krytox®, or Dow Corning® III O-Ring Valve Silicone Lubricant, or similar products to maintain the ease of motion for the pivot of the cap element 60 around the base element 30 along O-ring 90 within annular grooves, 78 and 50, respectively.

Embodiments of the push-button, locking hinge assemblies 10 and 12 provide the cap element 60 solid cast geometric end 62 and the base element 30 solid cast geometric end 32 which include, without limitation, geometric shapes of ovals, oblongs, triangles, squares, rectangles, pentagons, hexagons, heptagons, octagons, and other multi-sided polygons capable of securely holding the push-button, locking hinge assemblies 10 and 12 between corresponding external member components (i.e., 100 and 102, FIG. Nos. 1, 2, 8-11) while transferring directional forces applied to the external member components, 100 and 102, to and through the push-button, locking hinge assemblies 10 and 12.

Embodiments of the push-button, locking hinge assemblies 10 and 12 provide the cap element 60 solid cast geometric end 62 and the base element 30 solid cast geometric end 32 to be pressed fit into corresponding geometrically configured external member components (i.e., 100 and 102, FIG. Nos. 1, 2, 8-11).

The push-button element 14, the base element 30, and the cap element 60 of embodiments of the push-button, locking hinge assemblies 10 and 12 can be manufactured from brushed aluminum, high strength carbon-composites, steel, stainless steel, and any similar light weight, high strength metal alloys. The preferred embodiment of the push-button, locking hinge assemblies 10 and 12 consists of brushed aluminum.

Therefore, the foregoing is considered as illustrative only of the principles of the push-button, locking hinge assemblies. Additionally, since numerous modifications and changes will readily occur to those skilled in the art, it is not desired to limit the push-button, locking hinge assemblies to the exact construction and operation shown and described, and further, all suitable modifications and equivalents may be resorted to, falling within the scope of the push-button, locking hinge assemblies.

I claim:

1. A push-button, locking hinge assembly comprising, in combination:

a) a base element comprising: a solid cast geometric end comprising an internal recess sized to receive a resilient spring member; a cylindrical length comprising an external side and an internal side; a central longitudinal axis; a cylindrical recess defined by the cylindrical length internal sides; an open end; a plurality of uniform cogs evenly spaced along the cylindrical length internal side from the open end so that each cog length is disposed equidistant from and parallel to the central longitudinal axis, and the cogs are sized to fit and receive cogs along a push-button cylindrical body external side; and an annular groove around the cylindrical length external side, the annular groove defining a plane transverse to the central longitudinal axis;

b) a push-button element comprising: a cylindrical body comprising an external side and an internal side; a central longitudinal axis; an actuating end comprising a solid circular external surface and an internal surface; an open cylindrical end; a cylindrical recess defined by the cylindrical body internal sides; a plurality of cogs evenly spaced along the cylindrical body external side so that each cog length is disposed equidistant from and parallel to the cylindrical body central longitudinal axis; and an internal recess sized to receive a resilient spring member;

c) a cap element comprising: a solid cast geometric end comprising a central opening on the end sized to receive the push button actuating end; a cylindrical length comprising an external side and an internal side; a central longitudinal axis; a cylindrical recess defined by the cylindrical length internal sides; an open end sized to receive and hold the base open end; a plurality of uniform cogs evenly spaced along the cylindrical length internal side from the cap element end comprising a central opening to receive the push button actuating end so that each cog length is disposed equidistant from and parallel to the central longitudinal axis, and the cogs are sized to fit and receive the cogs along the push-button cylindrical body external side; and an annular groove around the cylindrical length internal side, the annular groove defining a plane transverse to the base central longitudinal axis and sized to receive and hold the O-ring received within the annular groove around the cylindrical length external side;

d) an O-ring sized to be received within (i) the annular groove around the base cylindrical length external side, and (ii) the annular groove around the cap cylindrical length internal side, the O-ring serving to provide a pivot surface between the base element and the cap element; and e) a resilient spring longitudinally disposed around the central longitudinal axes of the push-button, base and cap, and sized to be received by and engage the base internal recess and to be received by and engage the push-button internal recess, thus implementing restorative force to the push-button position after a depression force on the push-button actuating end external surface is released;

wherein the push-button, locking hinge assembly provides a locking feature when a push-button element actuating surface is in a disengaged, neutral position and the push-button element cogs simultaneously engage the base element cogs and the cap element cogs preventing any pivot between the base element and the cap element about the central longitudinal; axis;

wherein the push-button, locking hinge assembly provides a 360 degree pivot feature around the O-ring between the cap element and the base element, the pivot action being along a plane transverse to the central longitudinal axis and about the central longitudinal axis, when the push-button actuating end external surface is depressed inward by a pressure applied to the push-button element actuating end solid circular external surface disengaging the push-button element cogs from the cap element cogs and unlocking the push-button, locking hinge assembly; and wherein once the push-button element actuating end external surface returns to a neutral position by the action of the undepressed resilient spring when the pressure is withdrawn from the push-button element actuating end solid circular external surface, the push-button element cogs re-engage the cap element cogs and lock the push-button, locking hinge assembly into the adjusted pivoted position between the base element and the cap element about the central longitudinal axis.

2. The push-button, locking hinge assembly of claim 1, further comprising: an aperture centered on the base geometric end; a threaded opening on the push-button actuating end internal surface, and a threaded fastener sized to correspond to the threaded opening and join the base to the push-button by insertion of the threaded fastener into the assembly through the aperture centered on the base geometric end and extending along the central longitudinal axis within the resilient spring; wherein adjustment of the length of threaded fastener received by the push-button actuating end by rotation of the threaded fastener causes the push-button actuating end to protrude from a component surface receiving each cast geometric end or be flush with the component surface.

3. The push-button, locking hinge assembly of claim 1, wherein the cap element solid cast geometric end and the base element solid cast geometric end comprise geometric shapes selected from the group consisting of ovals, oblongs, triangles, squares, rectangles, pentagons, hexagons, heptagons, octagons, and other multi-sided polygons capable of securely holding the push-button, locking hinge assembly between corresponding external member components and transferring directional forces applied to the external member components to the push-button, locking hinge assembly.

4. A push-button, locking hinge assembly comprising, in combination:

a) a first housing comprising: an octagonal end; an open end; a cylindrical length comprising an internal surface, an external surface, and a recess between the first housing octagonal end and the first housing open end; a plurality of uniform cogs evenly spaced along the cylindrical length internal surface from the open end so that each cog length is disposed equidistant from and parallel to a central longitudinal axis, and each cog is sized to fit and receive similarly disposed cogs along a push-button cylindrical body external surface; and an annular groove around the first housing cylindrical length external surface, the annular groove defining a plane transverse to the central longitudinal axis;

b) a second housing comprising: an octagonal end comprising a centered aperture; an open end sized to receive and hold the first housing open end;

a cylindrical length comprising an external surface, an internal surface, and a recess between the second housing octagonal end and the second housing open end; a plurality of uniform cogs of evenly spaced along the cylindrical length internal side proximate to the second housing octagonal end so that each cog length is disposed equidistant from and parallel to a central longitudinal axis, and each cog is sized to fit and receive the cogs along a push-button cylindrical body external surface; and an annular groove around the second housing cylindrical length internal surface, the annular groove defining a plane transverse to the central longitudinal axis;

c) a push-button member comprising: a cylindrical body sized to be housed within the first housing and the second housing, the cylindrical body comprising an external surface, an internal surface, a recess, and an actuating end comprising a solid circular external surface sized to extend through the second housing octagonal end centered aperture to expose the push-button to allow operation of the button, an internal surface comprising a recess; and a plurality of cogs evenly spaced along the push-button member cylindrical body external surface so that each cog length is disposed equidistant from and parallel to a push-button member cylindrical body central longitudinal axis;

d) an O-ring sized to be received in a channel formed by the annular groove around the first housing cylindrical length external surface and the annular groove around the second housing cylindrical length internal surface once the first housing open end is received into the second housing open end; and e) at least one restoration member comprising a length and an aperture centered through the restoration member length, the restoration member sized to be received between the first housing octagonal end and the push-button member actuating end internal surface recess along the central longitudinal axis;

wherein the push-button, locking hinge assembly provides a locking feature when the push-button element actuating end external surface is in a disengaged, neutral position and the push-button element cogs simultaneously engage the base element cogs and the cap element cogs thus locking the hinge assembly and preventing any pivot between the first housing and the second housing about the central longitudinal axis;

wherein the push-button, locking hinge assembly provides a 360 degree pivot feature around the O-ring between the second housing and the first housing, the pivot action being along a plane transverse to the central longitudinal axis and about the central longitudinal axis, when the push-button actuating end external surface is depressed inward disengaging the push-button element cogs from the cap element cogs and unlocking the hinge assembly; and wherein once the push-button element actuating end external surface returns to a neutral position by the action of the restoration member when the pressure is withdrawn from the push-button element actuating end external surface, the push-button element cogs re-engage the second housing cogs and lock the hinge assembly into the adjusted pivoted position between the first housing and the second housing about the central longitudinal axis.

5. The push-button, locking hinge assembly of claim 4, further comprising: an aperture centered on first housing octagonal end; a threaded opening on the push-button actuating end internal surface recess, and a threaded fastener sized to correspond to the threaded opening and join the first housing to the push-button element by insertion of the threaded fastener into the assembly through the aperture centered on the base geometric end and extending along the central longitudinal axis within the restoration member; wherein adjustment of the length of threaded fastener received by the push-button actuating end by rotation of the threaded fastener causes the push-button actuating end to protrude from a corresponding aperture in a component surface receiving the second housing octagonal end or be flush with the component surface.

6. A push-button, locking hinge assembly comprising, in combination:

a) a rotatable housing comprising (i) two separate housing ends, each separate housing end sized to be press-fitted into and held by separate components to provide a pivot point between the separate components along a rotatable housing central longitudinal axis, each separate housing end comprising internal and external surfaces, and one rotatable housing end comprising an aperture from an external surface to an internal surface; (ii) a first cylindrical length between the rotatable housing ends, the cylindrical length comprising a first external surface and a first internal surface, and a first recess, the cylindrical length attached to the rotatable housing end comprising the aperture from the external surface to the internal surface, whereby the first external surface defines a space between the separate components once the rotatable housing has been press-fitted to and held by the separate components; (iii) a push-button element within the rotatable housing, the push-button element comprising a cylindrical body sized to be housed within the rotatable housing, the cylindrical body comprising an external surface, an internal surface, a recess, and a cylindrical actuating end sized to be accessed and activated through the rotatable housing end comprising the aperture, the push-button actuating end comprising an internal surface; (iv) resilient restoration member within the rotatable housing and disposed along the rotatable housing central longitudinal axis, the resilient restoration member contacting the rotatable housing end opposite the rotatable housing aperture end and the push-button actuating end internal surface;

b) locking means along the rotatable housing central longitudinal axis to contact the push-button element and the rotatable housing ends in a first position and to contact the push-button element and the rotatable housing end without the access aperture to the push-button element actuating end in a second position; and c) pivot means to rotate an unlocked housing end 360 degrees about the locked rotatable housing end along a plane orthogonal to the housing central longitudinal axis;

whereby pressure applied to the push-button actuating end provides the locking means second position;

whereby the locking means second position provides 360 degrees of rotation of the separate component attached to the rotatable housing end with access aperture to the push-button element actuating end along a plane orthogonal to the housing central longitudinal axis about the rotatable housing end without the access aperture to the push-button element actuating end; and whereby the locking means first position locks the push-button, locking hinge assembly and the separate components into a fixed arrangement along the rotatable housing central longitudinal axis.

7. The push-button, locking hinge assembly of claim 6, wherein the rotatable housing end without the access aperture to the push-button element actuating end further comprises an second extended cylindrical length comprising a second internal surface, a second external surface comprising a second annular groove around the second cylindrical length external surface, and a second recess, and wherein the first internal surface comprises a first annular groove around the first cylindrical length internal surface, wherein the a second external surface is sized to be received by the first internal surface such that the first annular groove and the second annular groove are aligned to provide a channel orthogonal to the housing central longitudinal axis.

8. The push-button, locking hinge assembly of claim 7, wherein the pivot means to rotate an unlocked rotatable housing end 360 degrees about the locked rotatable housing end along a plane orthogonal to the housing central longitudinal axis comprises an O-ring housed with the channel.

9. The push-button, locking hinge assembly of claim 8 further comprising an O-ring lubricant to maintain the ease of motion for the pivot means to rotate an unlocked rotatable housing end 360 degrees about the locked rotatable housing end along a plane orthogonal to the rotatable housing central longitudinal axis.

10. The push button, locking hinge assembly of claim 7, wherein the locking means along the rotatable housing central longitudinal axis to contact the push-button element and the rotatable housing ends in a first position and to contact the push-button element and the rotatable housing end without the access aperture to the push-button element actuating end in a second position comprises evenly spaced and sized cog lengths along the first internal surface, along the second internal surface, and along the push-button element cylindrical body external surface, the cog lengths disposed equidistant from and parallel to the central longitudinal axis.

11. The push-button, locking hinge assembly of claim 10, wherein the rotatable housing ends, push-button element, and cogs comprise materials selected from the group consisting of brushed aluminum, high strength carbon-composites, steel, stainless steel, and any similar light weight, high strength metal alloys.

12. The push button, locking hinge assembly of claim 7, further comprising means to adjust the push-button element actuating end alignment with a separate component surface.

13. The push button, locking hinge assembly of claim 12, wherein means to adjust the push-button element actuating end alignment with a separate component surface comprises:

a) an aperture centered on the rotatable housing end without the access aperture to the push-button element actuating end;

b) a threaded opening on the push-button actuating end internal surface recess; and c) a threaded fastener sized to correspond to the threaded opening and join the housing end without the access aperture to the push-button element actuating end to the push-button element by insertion of the threaded fastener into the assembly through the aperture centered on the rotatable housing end without the access aperture to the push-button element actuating end and extending along the central longitudinal axis within the resilient restoration member;

wherein adjustment of the length of threaded fastener received by the push-button element internal surface recess by rotation of the threaded fastener positions the push-button actuating end to protrude from a corresponding aperture in a component surface receiving the rotatable housing end with the access aperture to the push-button element actuating end or be flush with the component surface.

14. The push-button, locking hinge assembly of claim 6, wherein the resilient restoration member within the housing comprises a spring.

* * * * *